United States Patent [19]

Jouffray

[11] 3,985,234

[45] Oct. 12, 1976

[54] TELESCOPIC BOOM FOR A CRANE

[75] Inventor: Maurice Jouffray, Bron, France

[73] Assignee: Creusot-Loire, Paris, Cedex, France

[22] Filed: Dec. 16, 1974

[21] Appl. No.: 533,442

[30] Foreign Application Priority Data

Dec. 20, 1973 France ..... 73.45787

[52] U.S. Cl. ..... 212/144; 212/55; 52/111; 52/118

[51] Int. Cl.[2] ..... B66C 23/62

[58] Field of Search ..... 212/54–55, 212/144; 52/111, 115–117, 118, 121

[56] References Cited

UNITED STATES PATENTS

| | | | |
|---|---|---|---|
| 1,345,304 | 6/1920 | Zied | 212/55 |
| 2,508,835 | 5/1950 | Moon et al. | 52/118 |
| 2,920,725 | 1/1960 | Emmons | 52/118 |
| 3,620,579 | 11/1971 | Brown et al. | 212/55 X |
| 3,708,937 | 1/1973 | Sterner | 52/118 |
| 3,807,108 | 4/1974 | Johnston | 52/115 |
| 3,830,376 | 8/1974 | Fritsch | 212/144 |

FOREIGN PATENTS OR APPLICATIONS

| | | | |
|---|---|---|---|
| 1,400,591 | 4/1965 | France | 212/144 |

*Primary Examiner*—Robert J. Spar
*Assistant Examiner*—R. B. Johnson
*Attorney, Agent, or Firm*—Haseltine, Lake & Waters

[57] ABSTRACT

A telescopic boom of a crane comprising a base element adapted for support on a turret of the crane, and a plurality of telescopic elements slidably engaged within one another and within the base element. The elements have a polygonal cross-section, each element having a lower or inner compression leg of inverted V-shape which opens downwardly and falls the load. First guide shoes are mounted on each telescopic element on the upper or outer leg thereof, bearing against the surrounding element, and second guide shoes are mounted on each branch of the inverted V-shaped inner leg also bearing against the surrounding element.

6 Claims, 2 Drawing Figures

TELESCOPIC BOOM FOR A CRANE

FIELD OF THE INVENTION

The invention relates to a telescopic boom of a mobile crane and more particularly to the shape and guide means for the elements engaged with one another to constitute the boom, which is adjustable in length, as a function of the work to be effected, to be reduced in size during travel on roadways.

PRIOR ART

A number of telescopic booms are known in which the control for retraction and extension are effected usually hydraulically. Such booms are generally in the form of telescopic casings having thick plates or thin plates with reinforcing ribs; in cross-section the casings can be rectangular, triangular or trapezoidal. To assure correct sliding and guiding of the casings on one another, despite the necessary play, guide members are employed such as slide shoes or roller bearings interposed between adjacent slidable elements.

However, it is obviously not possible with a metal frame to realize elements of great length with great precision, and the play between elements is variable during their relative displacement. As a result of this, it is not possible in practice to have a perfect adjustment of the guide members.

The residual play in the working plane, or the plane of loading, is not very objectionable as the boom elements are always applied against one another in the same manner by their weight or by the load, and the recovery of the play is always ensured in the same direction. This is not the case for lateral play and its variable recovery reduces this by the uncontrolled lateral balancing on the boom. This is very detrimental to the precision of movement and results in the generation of additional forces in the boom. It is to be appreciated that these disadvantages become even more significant with booms of much greater lengths.

Furthermore, because of the discontinuity of the elements, and their encasement one within the other, there is produced in these pieces, very substantial bearing reactions applying, in the bearing zones, significant local forces which are transmitted to the assembly of the structure through the intermediary of the lateral walls. The risk of buckling thereof often constitutes a resistance limit for the boom.

SUMMARY OF THE INVENTION

An object of the present invention is to provide a boom construction which overcomes these disadvantages by the realization of a telescopic boom in which the lateral guiding of the elements with respect to one another is independent of the relative play existing between the elements and in which the risk of buckling of the lateral walls is reduced.

The invention is applicable to a telescopic boom of a crane comprising a base element articulated on a turret of the crane and telescopic elements which engage within one another and in the base element, the assembly of the elements having a transverse polygonal section, the elements additionally comprising guide means for their relative movement.

According to the invention, for each element, the lower or inner leg is in the form of an inverted V, diverging downwardly, and the guide members are disposed, on the one hand, at the upper portion between the upper or outer legs of the different elements, and, on the other hand, at the lower or inner portion between the branches of the same inclination of the inverted V-shaped legs of the different elements.

According to a particular preferred embodiment of the invention, in the case where the transverse section of the telescopic elements can be regarded as having the general outer form of an isosceles trapezoid, the inner legs of the inverted V-shape constitute the small base of the trapezoid. As will be explained and can be seen from the accompanying drawing, the trapezoid has an inwardly tapering smaller base that includes two sections on either side of an obtuse angle.

This invention will next be described in greater detail with reference to a particular embodiment given by way of example, and illustrated in the attached drawings.

DETAILED DESCRIPTION

Figure 1:
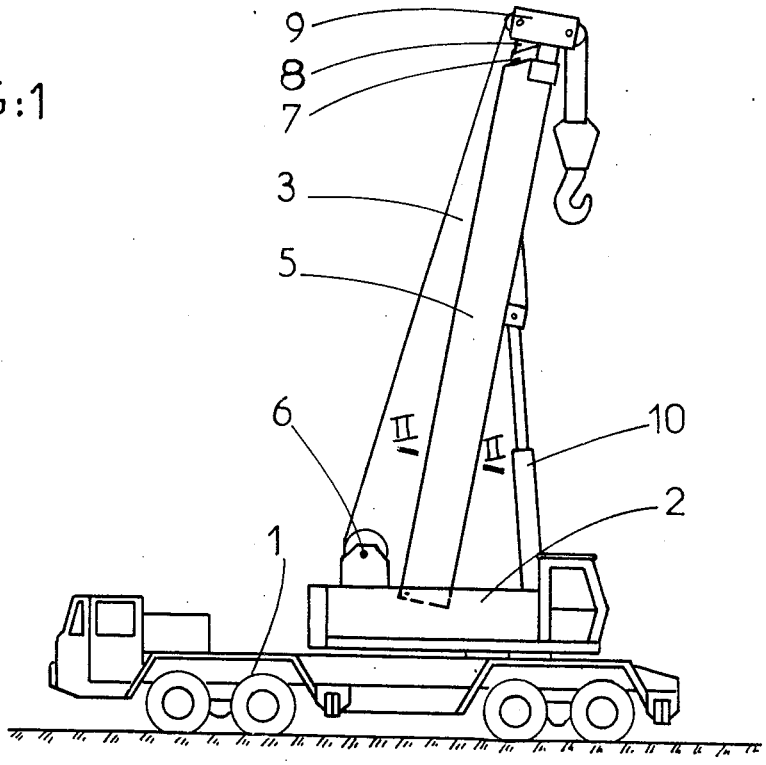
FIG. 1 is an elevational view of a mobile crane having a telescopic boom shown in the position of minimum extension of the boom.

The mobile crane is principally constituted in conventional fashion by a chassis 1 rollable on the ground and on which is mounted a rotatable turret 2. A telescopic boom designated generally by 3 is composed of four elements: a base element 5 pivoted at 6 on the turret 2 and three telescopic elements, 7,8,9. The inclination of the boom 3 is adjusted by a jack 10, pivotably connected to the turret 2 and to the base element 5 of the boom.

The elements 5,7,8,9 are constituted as casings whose section has the general appearance of a trapezoid (FIG. 2) whose smaller base is constituted by the lower, inner or compression leg of the casing. It can be seen from FIG. 2 that the inverted V-shape constitutes the smaller base of the trapezoid the base including two sections on either side of an obtuse angle. The four elements 5,7,8,9 are of equivalent construction and, by way of example, reference will next be made to one of the intermediate elements 7.

Figure 2:
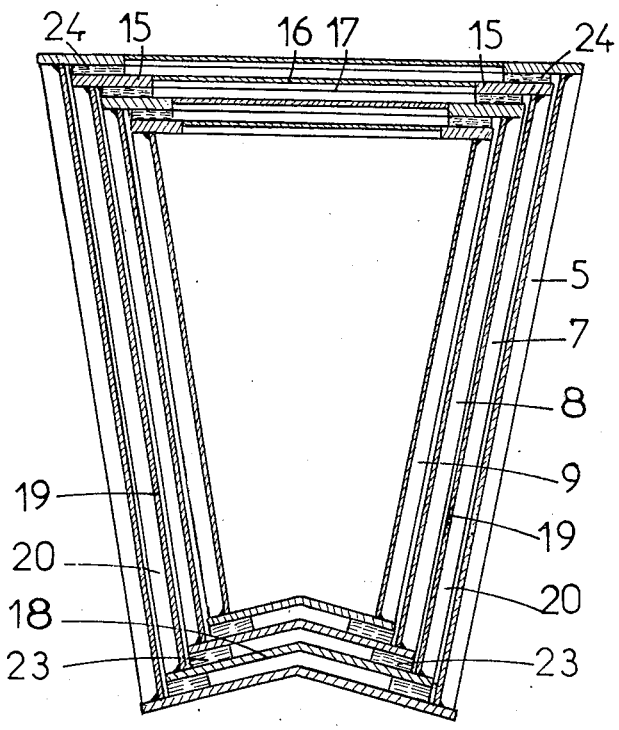
FIG. 2 is a section taken through the telescopic boom along line II—II in FIG. 1, when the boom is completely retracted.

The element 7 comprises an upper, outer or tension leg constituted by two longerons 15 of substantial strength, capable of ensuring a proper distribution of the stresses, the two longerons 15 being connected by a connection plate 16 which is relatively thin and reinforced by profiled reinforcements 17, as visible in FIG. 2.

The lower or inner leg of the casing 7 is constituted by a bent plate 18 of inverted V-shape whose branches diverge downwardly. On each side, the upper and lower (outer and inner) legs are connected by plates 19 of relatively small thickness, with reinforcements 20 welded horizontally and vertically, as visible in FIG. 2, preferably additionally welded at their extremities, on the one hand, to the lower (inner) bent leg or plate 18 and, on the other hand, to the upper (outer) longerons 15.

At the lateral extremities of leg 18 or lower (inner) slide shoes 23 which bear against the branches of the lower (inner) V-shaped leg 18 of the exterior element 5. Similarly, at the upper (outer) portion, the longerons 15 are connected to slide shoes 24 which bear on corresponding longerons 15 in the element 5. It can be observed that in the thus constituted assembly, there exists throughout lateral play between the various interpenetrating elements.

It is further noted, for the boom thus constituted, that the inner slide shoes of one element, mounted on an inclined branch of the inner leg of this element, are themselves borne on an inclined branch of the same slope of the carrier element which surrounds it. This produces a self-centering of the carried element with respect to the carrier element; the self-centering reactions are furthermore proportional to the load.

It is seen that the alignment condition of the elements with respect to one another is automatically realized without it being necessary to have lateral guides, properly said, of which there is furthermore seen above that it would not be able to fulfill their operation with efficiency by reason of the irregularity of the transverse play due to the construction of the metallic frame. This therefore permits achieving a reduced need for precision in the transverse dimensions of the elements, which is obviously translated into a more economical construction.

In the preferred embodiment which has been shown in FIG. 2, the branches of the V formed by the leg 18 are perpendicular to the lateral walls 19. Additionally, the lateral walls 19 are each in a plane passing through the center of the corresponding shoe 23. As a result thereof, the local bearing forces are directed in the same direction as the lateral wall and without producing any bending moment tending to effect buckling of the lateral wall.

It is well understood that the invention is not strictly limited to the embodiment which has been described but it covers other embodiments which are distinguished only by details of execution or by the utilization of equivalent means.

It is noted in particular that the described form of a trapezoidal shape, with the inverted small base at its lower or inner end, has the additional advantage of reducing the width of the lower or inner compression side, which is more loaded, and whose V form adds to the moment of inertia, and therefore provides better strength while conferring, on each element, an increased resistance to buckling.

The combination of the trapezoidal form with the small base at the inner portion, and of inverted V-shape of this small base, therefore provides a weight reduction of the structure, improved strength of the boom to lateral buckling, improved performance, and greater precision of maneuverability in the utilization of the crane.

What is claimed is:

1. A telescopic boom of a crane for lifting a load, comprising: a base element for support on a turret of the crane; a plurality of telescopic elements slidably engaged with one another and with said base element, said telescopic elements having a configuration of a five sided polygonal in cross-section with the general outer appearance of an isosceles trapezoid, each element having a substantially horizontal upper section, inwardly tapering walls, a branched base section including two legs forming an obtuse angle of an inverted V-shape, means connecting said walls to said base and upper section, said walls extending perpendicularly to the respective leg of said base section, first guide means mounted on said horizontal section for engaging a surface of an adjacent telescopic element, and second guide means mounted on each leg of the base of the respective inner element relative to said base element.

2. The telescopic boom as claimed in claim 1 wherein said guide means on said leg are constituted by guide members disposed so that said walls lie in planes which pass through the centers of respective guide members.

3. The telescopic boom as claimed in claim 2 wherein said guide means on said leg have inclined faces parallel thereto.

4. The telescopic boom as claimed in claim 1 wherein said first guide means includes a pair of laterally spaced guide shoes adjacent the lateral sides of the corresponding said telescopic element.

5. The telescopic boom as claimed in claim 1 wherein said branched base section is a bent plate.

6. The telescopic boom as claimed in claim 1, wherein said legs and walls include reinforcement means; said legs and said walls of one telescopic element being spaced from the corresponding, legs and walls of an adjacent element.

* * * * *